United States Patent [19]
Ebner et al.
[11] 4,317,405
[45] Mar. 2, 1982

[54] APPARATUS FOR SUPPORTING A WEAPON SYSTEM UPON A COMBAT VEHICLE

[75] Inventors: Walter Ebner, Wettingen; Werner Kramis, Schwerzenbach; Gustav Studer, Dällikon, all of Switzerland

[73] Assignee: Contraves AG, Zurich, Switzerland

[21] Appl. No.: 52,337

[22] Filed: Jun. 27, 1979

[30] Foreign Application Priority Data

Jul. 5, 1978 [CH] Switzerland ..... 7319/78

[51] Int. Cl.[3] ..... F41F 23/06; F41F 23/34

[52] U.S. Cl. ..... 89/37 G; 89/40 C; 89/40 J; 89/40 K

[58] Field of Search ..... 89/37 G, 37 L, 40 R, 89/40 A, 40 B, 40 C, 40 D, 40 J, 40 K

[56] References Cited

U.S. PATENT DOCUMENTS 652,154 6/1900 Wilding ..... 89/40 R
709,301 9/1902 Capps ..... 89/40 R
4,222,307 9/1980 Roettges et al. ..... 89/37 G

FOREIGN PATENT DOCUMENTS 71373 9/1915 Fed. Rep. of Germany ..... 89/40 J

*Primary Examiner*—Stephen C. Bentley
*Attorney, Agent, or Firm*—Werner W. Kleeman

[57] ABSTRACT

An apparatus for supporting a weapon system upon a combat vehicle, at which vehicle the weapon system is arranged upon a platform and is mounted to be rotatable about an essentially vertical axis. Between the chassis frame of the vehicle and the platform there is arranged an intermediate frame which is operatively connected, with the chassis frame, by means of three support devices arranged in spaced relationship from one another. The intermediate frame, together with the platform carrying the weapon system, viewed in the direction of travel of the vehicle, can be lowered and/or raised in relation to the chassis frame at least at one side. The individual support devices of the three point-support arrangement are structured for handling angular and displacement movements.

9 Claims, 20 Drawing Figures

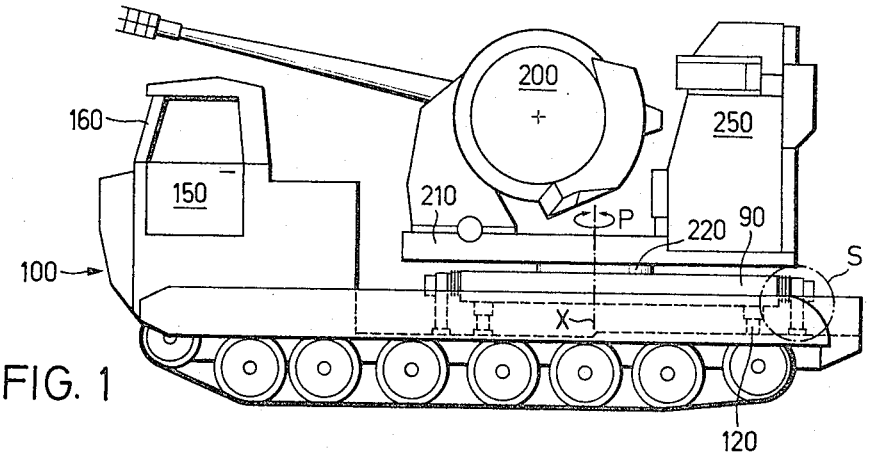
FIG. 1
FIG. 2
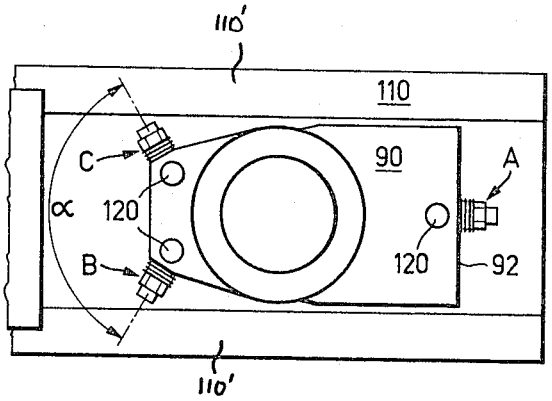
FIG. 4
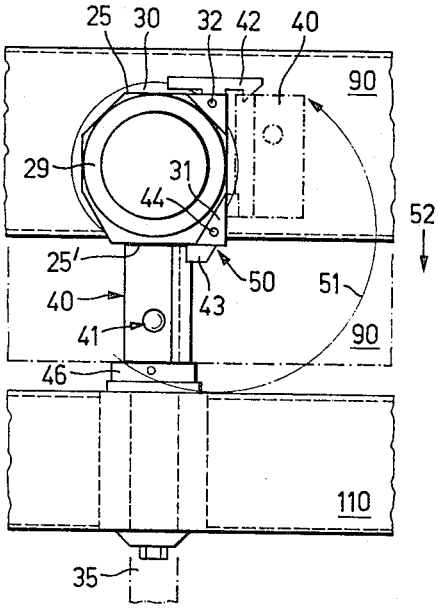
FIG. 3
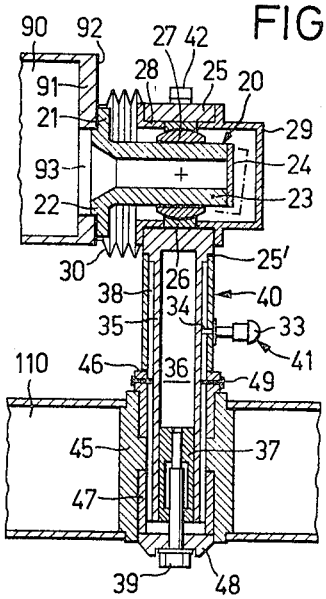

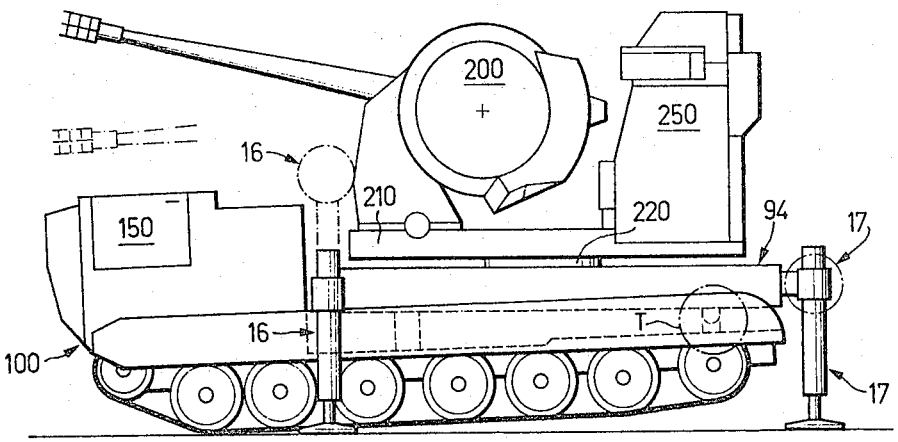
FIG. 5
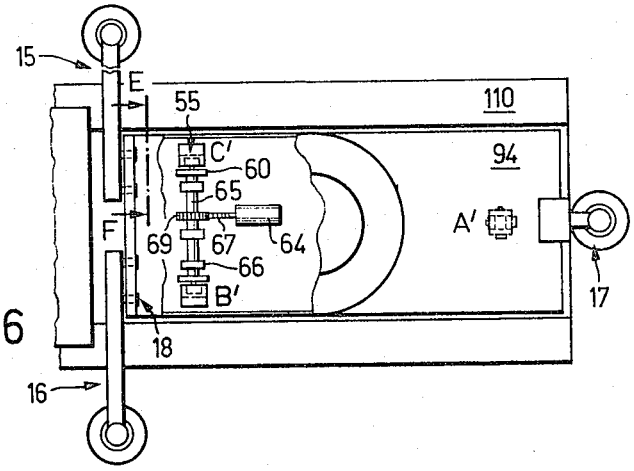
FIG. 6
FIG. 8a
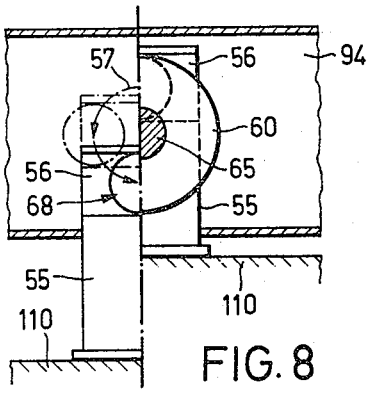
FIG. 8
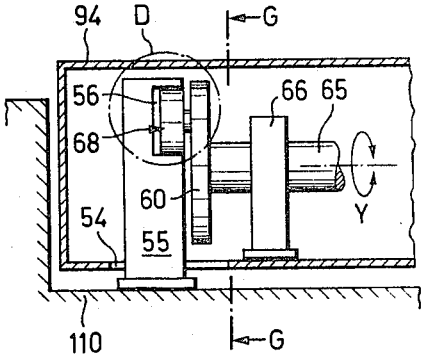
FIG. 7

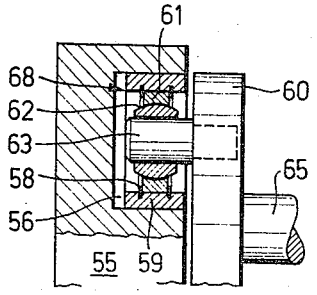
FIG. 9
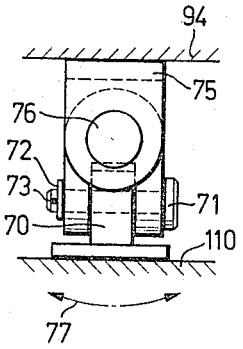
FIG. 10
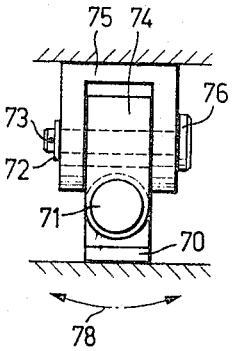
FIG. 11
FIG. 12
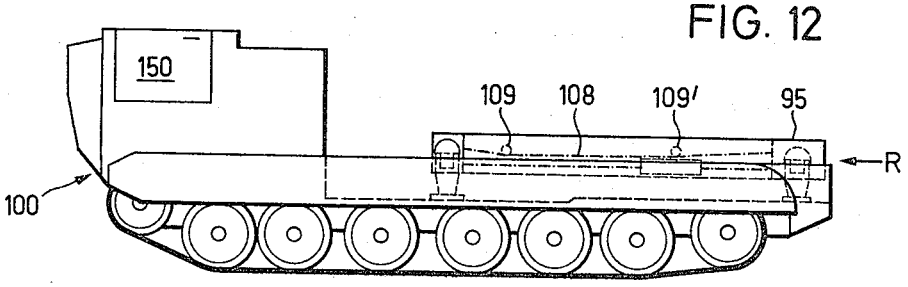
FIG. 13
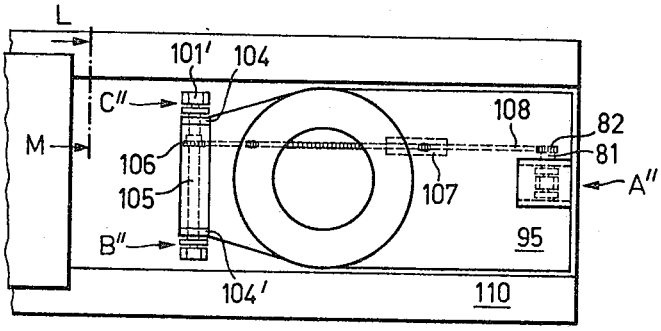

FIG. 15a
FIG. 15
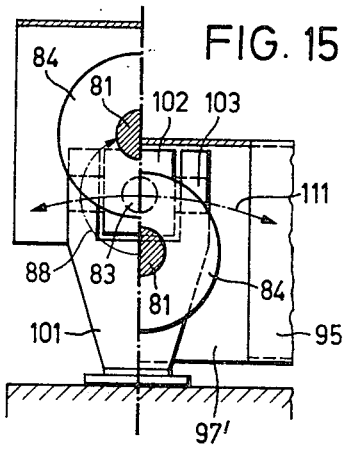
FIG. 14
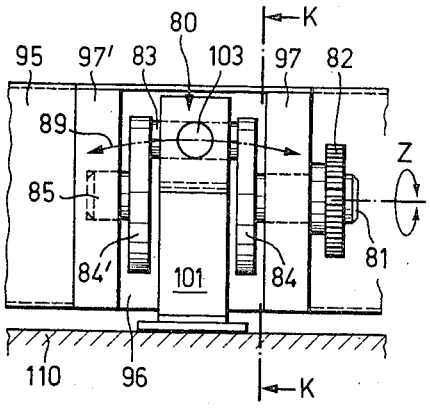
FIG. 17
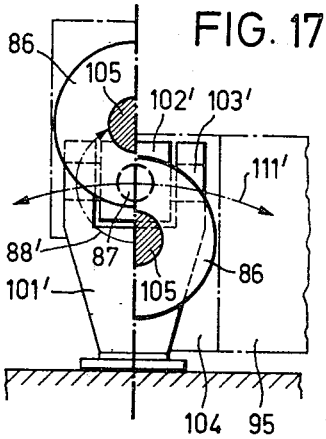
FIG. 16
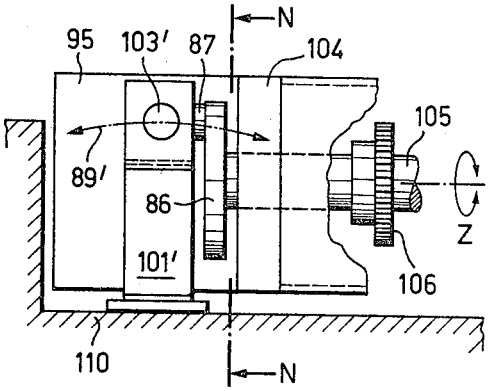
FIG. 17a

APPARATUS FOR SUPPORTING A WEAPON SYSTEM UPON A COMBAT VEHICLE

BACKGROUND OF THE INVENTION

The present invention relates to a new and improved construction of apparatus for supporting a weapon system or weaponry at a combat vehicle.

Generally speaking, the apparatus of the invention is of the type wherein at the combat vehicle, the weapon system arranged at a platform to be rotatable about an essentially vehicle axis, is mounted together with an intermediate frame, by means of three mutually spaced support devices, at the chassis frame of the vehicle.

There is known to the art from the commonly assigned, U.S. Pat. No. 3,946,640, granted Mar. 30, 1976, a mobile combat vehicle wherein a weapon system arranged upon a platform and mounted to be rotatable about a vertical axis by means of a pivot bearing, is supported at the vehicle chassis by means of three mutually spaced pivot supports and an intermediate frame. The pivot supports arranged between the chassis and the intermediate frame prevent transmission of the torsional moments of the vehicle to the weapon system. This combat vehicle has a relatively high situated center of gravity. Such has a disadvantageous effect, when encountering extreme operating conditions, upon the operation of the weapon system constructed, for instance, as a rocket launcher or cannon or the like. Additionally, the relatively large, unalterable structural height of the entire combat vehicle limits the traveling characteristics and transport possibilities of the vehicle, especially however the ability to transport the vehicle by means of railroads.

Furthermore, it is generally known in the case of wheeled or tracked vehicles, to arrange a platform upon the vehicle chassis frame. The platform serves to accommodate, for instance, dismantable support elements for lifting and assembly platforms, or, however, for the mounting of parts for bucket excavators or the like. With such vehicles the platform is essentially supported by a conventional three point-support arrangement at the chassis frame of the vehicle. The one side of the support arrangement can be provided, for instance, as viewed in the direction of travel of the vehicle, with pivotable pivot supports, or, however, with extensively freely movable ball-and-socket supports, and the other side can be equipped with mechanical or hydraulic means for horizontally positioning the entire platform in relation to the chassis frame.

SUMMARY OF THE INVENTION

It is a primary object of the present invention to provide a new and improved construction of apparatus for supporting a weapon system upon a combat vehicle in a manner not associated with the aforementioned drawbacks and limitations of the prior art proposals discussed above.

Another and more specific object of the present invention aims at providing a combined apparatus for supporting a weapon system mounted upon a combat vehicle, in a manner preventing transmission of the torsional, bending and elongation forces to the weapon system, arising during vehicle travel and/or combat at the chassis frame, and by means of which, additionally, the weapon system can be placed in a more favorable position both for operation thereof during vehicle travel and also as concerns the loading size permissible for railroad transport.

Yet a further significant object of the present invention aims at devising a new and improved construction of apparatus for supporting a weapon system upon a combat vehicle in a highly reliable, manner, so that the firing capability of the weapon system is not adversely affected in any appreciable manner during vehicle travel.

Now in order to implement these and still further objects of the invention, which will become more readily apparent as the description proceeds, the apparatus of the present invention is manifested by the features that the support devices which are operatively connected with the intermediate frame and the chassis frame are structured for taking-up or handling angular and displacement movements and, viewed in the direction of travel of the vehicle, serve for raising and lowering the intermediate frame carrying the weapon system at least at one side in relation to the chassis frame.

According to a further aspect of the invention, the weapon system can be aligned in horizontal and stabilized, in relation to the combat vehicle, by means of additional supports bearing at the ground and pivotably secured at the intermediate frame. Moreover, the vehicle can be lowered at the side of the bow, in relation to the horizontally aligned weapon system, in order to beneficially obtain a maximum lowering of the weapon.

To this end, both of the oppositely situated support devices are operatively interconnected with one another by means of a shaft rotatably driven about its lengthwise axis by means of a cylinder arranged at the intermediate frame.

In order to construct the apparatus, particularly however the support devices, as effectively as possible, the invention contemplates that the intermediate frame together with the weapon system, can be lowered and raised, as the case may be, by a pivotable movement directed in the lengthwise direction of the vehicle, and, in relation to its starting position, extending parallel to the chassis frame.

In this regard, both of the forward, oppositely situated support devices are likewise operatively interconnected by a first shaft, and the rear support device is equipped with a second shaft arranged essentially parallel to the first shaft. Driving of both shafts is accomplished by an intermittent traction element driven by a cylinder arrangement.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 illustrates in side view a combat vehicle having the inventive support arrangement for a weapon secured at the intermediate frame upon the chassis frame of the combat vehicle;

FIG. 2 is a top plan view of part of the combat vehicle, shown in the arrangement of FIG. 1, without the weapon system, disclosing details of the arrangement of the bearing and support points A, B and C for the intermediate frame at the chassis frame of the vehicle;

FIG. 3 illustrates on an enlarged scale and in sectional view a detail of the location S, shown in a circle in FIG. 1, of the bearing and support point A;

FIG. 4 is a side view of the bearing and support point A according to FIG. 3;

FIG. 5 illustrates the combat vehicle in its firing position and equipped with a first variant construction of a bearing or mounting arrangement for mounting the intermediate frame upon the chassis frame of the vehicle;

FIG. 6 is a top plan view of part of the combat vehicle shown in FIG. 5, omitting the showing of the weapon system, and illustrating the arrangement of the bearing and support points A', B' and C' of such modified embodiment;

FIG. 7 is an enlarged view, partially in section, taken along the line E–F of FIG. 6, showing part of the bearing and support point C';

FIGS. 8 and 8*a* are sectional views, along the line G—G of FIG. 7, wherein FIG. 8 illustrates the travel position of the vehicle and FIG. 8*a* the vehicle lowered at its bow side;

FIG. 9 is a detail, on an enlarged scale and partially in sectional view, of the location D designated within a circle in FIG. 7;

FIG. 10 is a detail showing, on an enlarged scale, of the location T, designated within a circle in FIG. 5, of the bearing and support point A' in front view;

FIG. 11 is a side view of the point A' according to FIG. 10;

FIG. 12 illustrates a further variant construction of a mounting or support arrangement for an intermediate frame upon the chassis frame or chassis of the vehicle, showing the combat vehicle, without its weapon system, in side view;

FIG. 13 is a top plan of part of the combat vehicle shown in FIG. 12, detailing the arrangement of the mounting and support points A'', B'' and C'' of such further constructional embodiment of FIG. 12;

FIG. 14 illustrates on an enlarged scale and in front view, looking in the direction of the arrow R of FIG. 12, the mounting and support point A'' shown in such FIG. 12;

FIGS. 15 and 15*a* are sectional views, taken along the line K—K of FIG. 14, wherein the intermediate frame has been respectively shown in its lowered and raised position;

FIG. 16 illustrates on an enlarged scale and in front view, according to the line L–M of FIG. 13, part of the mounting and support point C'' illustrated in such FIG. 13; and FIGS. 17 and 17*a* are respective sectional views according the line N—N of FIG. 16, wherein there has been illustrated the intermediate frame in its lowered position and raised position, respectively.

DETAILED DESCRIPTION OF THE PREFERRED EMBODIMENTS

Describing now the drawings, in FIGS. 1, 5 and 12 there is shown, in side view, a combat vehicle wherein the vehicle itself is generally designated by reference character 100, the chassis frame or chassis of the vehicle by reference character 110 and the driver or operator's cabin by reference character 150. The driver or operator's 150 can comprise, for instance, a removable cabin roof or ceiling element 160. The chassis frame or chassis 110, constructed for instance as a substantially tub or vat-like unit, serves for housing and mounting an intermediate frame 90 which can be raised and lowered in relation to the chassis frame or chassis 110. This intermediate frame 90 is arranged between both side walls 110' of the chassis frame 110 and can be constructed, typically by way of example, in a box-like configuration and for housing a not particularly further illustrated azimuth-pivot bearing means 220. A platform 210 is secured upon the pivot bearing 220. Arranged upon this platform 210 is a weapon 200, for instance a cannon or the like, and furthermore, a cabin 250, these components being attached by any suitable and therefore not particularly illustrated fixing or attachment means. The platform 210, with the weapon or weapon device 200 arranged thereupon, and the cabin 250 are rotatable, in relation to the intermediate frame 90, about an essentially vertical axis X of the pivot bearing means 220 in the direction of the arrow P.

Now in FIG. 2 there is shown in top plan view a portion of the combat vehicle 100, but without the weaponry 200. There will be again seen the substantially tub or vat-shaped chassis 110, and further, the mounting and support points or locations A, B and C arranged in spaced relationship from one another. These mounting and support points A, B and C—also sometimes referred to herein as bearing and support points—are attached, on the one hand, at the chassis frame 110, and, on the other hand, at the intermediate frame 90. In FIG. 1, both of the mounting and bearing points B and C have been shown, to simplify the illustration, shifted or offset. Arranged appropriately with regard to the mounting and support points A, B and C is a respective lifting or displacement cylinder arrangement 120. The displacement cylinder arrangements, constituted by conventional piston- and- cylinder units, are provided for the purpose of raising and lowering the intermediate frame 90, the platform 210 and the weapon 200, secured to such platform, along with the cabin 250. Hence, as will be clearly understood and quite self-evident, these displacement cylinder arrangements or units 120 are appropriately dimensioned. The mounting and support points A, B and C collectively form a three point-support arrangement. Both of the points B and C are arranged symmetrically with respect to one another at the one end of the intermediate frame 90, whereas the mounting and support point A is attached at the other end of the intermediate frame 90. Both of the points or locations B and C are dispositioned at an angle $\alpha$ relative to one another, this angle being in the order of magnitude of approximately 120°. For the purpose of receiving and attaching the essentially similarly constructed mounting and support points A, B and C, the intermediate frame 90 is constructed so that it is formed at corresponding locations with a respective contact or bearing surface 92 which is formed by a side wall 91.

Now in FIG. 3 there is shown, as an exemplary embodiment, and on an enlarged scale and in sectional view, the mounting and support point or location A which appears within the circle S of the arrangement of FIG. 1, and as to be described more fully hereinafter.

This mounting and support point A essentially comprises a bearing journal or pin 20 attached at the intermediate frame 90, a housing 25 having formed thereat a support element 35, a pivotable spacer element 40 or equivalent structure articulated at the housing 25, and a guide element 45 for the support element 35, which guide element is fixedly connected with chassis frame 110. In order to receive the bearing journal or pin 20 an opening 93 is provided in the side wall 91 of the intermediate frame 90. Within the opening 93 there is centered the bearing or mounting journal 20 having a shoulder 22 or the like. The bearing or mounting journal 20 bears, by means of its flange 21, at the contact surface 92, and is secured in the opening 93 by any suitable securing means. At the side opposite the flange 21 the cylindrical portion or part 23 of the bearing journal 20 is preferably closed by a cover or end closure 24.

The bearing journal or pin 20, coaxially arranged in the housing 25, is mounted by means of its cylindrical part or portion 23 in a spherical part or ball 27 and the latter is mounted in a ball socket 26 or the like. The ball socket 26 is secured against axial displacement in the housing 25 at the one side, by means of a first bushing or sleeve 28, and at the other side by a second bushing or sleeve 29. The bushing 28 and the bushing 29, preferably structured as a closure cap, are attached by any suitable and therefore not particularly shown means at the housing 25. The mounting and support points A, B and C are protected against contamination at one side by the related closure cap 29 and at the other side by a collar 30 or equivalent structure. Collar 30 is attached at one face at the flange 21 of the bearing journal 20 and at the other face at the housing 25, there being used any suitable standard attachment or fastening means for such purpose.

The tubular-shaped support element 35, formed at the housing 25, is coaxially arranged in the guide element 45. This support element 35 is guided at its upper end through a first inner bushing 46 and at its lower end through a second inner bushing 47. Support element 35 possesses at least two guide grooves 38 distributively arranged at its circumference, in which engages a respective bolt 49 or equivalent element mounted in the bushing 46, so that the support element 35 is secured against rotation.

At the lower end of the support element 35, which is provided with a bore 36, there is inserted a bushing 37 and fixedly connected with such support element 35. Thus bushing 37 comprises a not further designated threaded portion and a guide portion and serves for receiving a tensioning bolt or screw 39 or the like. By means of the tensioning or tightening screw 39 which is operatively connected with the support element 35 and the housing 25 and a tensioning or tightening element 48, bearing at the bushing 47 of the guide element 45, the intermediate frame 90, which is essentially spaced by the spacer element 40 from the chassis frame 110, is drawn against the guide element 45 which is fixedly connected with such chassis frame 110. Consequently, the chassis frame 110 is essentially rigidly operatively connected with the intermediate frame 90.

Now in FIG. 4 there has been illustrated in side view the mounting and support point A. There will be recognized the milti-edged or polygonal housing 25, the intermediate frame 90, the chassis 110 and the spacer element 40. Attached at the housing 25 at one side are two brackets 31 arranged in spaced relationship from one another. Between these spaced brackets 31 there is arranged a bracket or strap 43 attached at the spacer element 40 and retained by a shaft or axle 44. The parts 31, 43 and 44 collectively form a schematically illustrated pivot bearing means 50, by means of which the spacer element 40 can be rocked about the axle or shaft 44 along the pivot line 51 into the phantom line position. Such movement of the spacer element 40 can be accomplished after loosening a not further illustrated locking element 41 provided with a handle or operating member 33 and latching by means of a pin 34 into the groove 38 of the support element 35 and after the tightening screw 39 has been partially screwed-out and the intermediate frame 90 has been raised, relative to the chassis frame 110, by the displacement cylinders 120 by an amount allowing for a certain corresponding free pivot radius. The thus rocked or pivoted spacer element 40 can be held in this position by means of a pawl or latch 42 pivotable about the axle or shaft 32 and secured in any suitable fashion at the housing 25.

When the corresponding spacer elements 40 of the mounting and supporting points A, B and C have been rocked and retained in desired position by their related pawls 42, it is then possible to lower, by means of the displacement cylinder arrangements 120, the intermediate frame 90, and thus, also the platform 210 with the weapon 200 secured thereon and the cabin 250, in the direction of the arrow 52 of FIG. 4 into the phantom line position. In the illustration of FIG. 4 only part of the intermediate frame 90 has been shown for simplification purposes. In this position the housing 25 bears, by means of its contact surface 25', upon the upper edge of the inner bushing 46 and the support element 35 with the tightening screw 39 and the tightening element 48 protudes past the underside of the chassis frame 110 (again only partially shown in FIG. 4). Lowering of the intermediate frame 90 together with the weapon system, composed of the parts 200, 210 and 250, secured thereon, is particularly required when the combat vehicle must be transported by railway. The mounting and support points A, B and C, according to the embodiment of FIGS. 3 and 4 show a first combined apparatus for supporting the weapon system.

By means of the mounting and support points A, B and C, constructed in this manner and affording a stable attachment, free of play, of the entire weapon system upon the combat vehicle, the torsional, bending and elongation forces, arising both during vehicle travel and also upon firing of the weapon at the chassis frame, are not transmitted to the weapon system. The angular and displacement movements, as for instance indicated by way of example in FIG. 3 for the phantom line illustrated portion of the axial journal 20, are absorbed by the bearing journal 20 mounted to be axially displaceable in the spherical part 27. With the combat vehicle shown in FIG. 1, the intermediate frame 90 with the weapon system attached thereon, has intentionally not been aligned in horizontal direction in relation to the combat vehicle which, for instance, is obliquely positioned due to irregularities in the terrain.

Continuing, in FIGS. 5 and 6 there has been shown, in conjunction with the combat vehicle of FIG. 1, a first modified version of intermediate frame 94 as well as the mounting of such intermediate frame. There will be recognized the combat vehicle which is shown in its firing position and with the cabin roof removed. The weapon system, secured by means of the platform 210 upon the intermediate frame 94, has been horizontally aligned and stabilized by the supports 15, 16 and 17 attached at the intermediate frame 94. The components 100, 110, 150, 200, 210, 220 and 250 correspond to those parts of the combat vehicle shown in FIG. 1. The supports 15, 16 and 17 are pivotably mounted at the intermediate support 94 and hydraulically pivotable into the phantom line position shown in FIG. 5 for the traveling mode of the combat vehicle and can be locked in such position by means of a respective locking mechanism 18.

In the top plan view of FIG. 6, there has been shown part of the combat vehicle, without its weapon, and there will be recognized the chassis frame 110, the supports 15, 16 and 17 attached at the intermediate frame 94 and shown in the pivoted-out position. Further, there will be seen the mounting and support points A', B' and C', arranged in spaced relationship from one another. These mounting and support points or locations A', B' and C' are arranged essentially within the box-like configured intermediate frame 94 shown partially in sectional view.

Continuing, both of the mounting and support points B' and C' are essentially of the same construction, and to therefore simplify matters, hereinafter there will be described in detail the mounting and support point or location C'. In FIG. 7 there is shown the point or location C', in front view and on an enlarged scale, taken along the line E–F of FIG. 6. There will be recognized a shaft 64 arranged in the intermediate frame 94 tranversely with respect to the direction of travel of the combat vehicle. This shaft 65 is rotatably mounted in at least two bearing blocks or pillow blocks 66 or equivalent structure, arranged in spaced relationship from one another and fastened by any appropriate fixing means at the intermediate frame 94. This shaft 65 is moved in the direction of the arrow Y of FIG. 7, by the displacement cylinder 64, illustrated schematically in FIG. 6. This drive or displacement cylinder unit 64 is operatively connected through the intermediary of a rack 65 with a gear or pinion 69 connected rigidly for rotation with the shaft 65. At both ends of the shaft 65 there is provided a respective disk 60 rigidly connected for rotation with such shaft 65. Rotatably eccentrically secured at each disk 60 is a respective bearing element 68. In spaced relationship from the disk 60 there is arranged to each side a bearing block 55 which is fixedly connected by suitable securing or fixing means with the chassis 110, such bearing block protruding through an opening 54, provided at the intermediate frame 94, into the interior of such intermediate frame 94. At its upper region the bearing block 55 has a recess 56 in which there is guided for to-and-fro movement the bearing element 68 by virtue of the rotational movement Y of the disk 60 and the shaft 65.

Now in FIG. 9 there is shown as an exemplary embodiment of the bearing element 68 shown within the circle D of FIG. 7. The showing is on an enlarged scale and partially in sectional view. There will be recoginized the disk 60 arranged in spaced relationship with respect to the bearing block 55. At the disk 60 there is secured eccentrically an axial pin or journal 63. Upon the axial pin 63 there is arranged a spherical part or ball 62 mounted in a ball socket 61. The ball socket 61 is inserted into a housing 59 forming a bearing race and is secured against axial displacement in such housing 59 by two securing rings 58 arranged in spaced relationship from one another.

Now FIGS. 8 and 8*a* show the mounting and support point C' in side view along the line G—G of FIG. 7. More specifically, FIG. 8 illustrates the chassis frame 110 and the intermediate frame 94 in the vehicle travel position, while FIG. 8*a* illustrates the chassis frame 110, in relation to the horizontally aligned intermediate frame 94, in the firing position.

In FIGS. 10 and 11 there have been shown in front view and side view, respectively, the mounting and support point or location A', delimited in FIG. 5 by the circle T. The showing is on an enlarged scale and the mounting and support point A', serves for the mounting and support of the intermediate frame 94 as will be recalled. Upon the chassis frame 110 there is secured, by suitable securing means, such as threaded bolts, screws or the like for instance, a first bearing block 70 and at the intermediate frame 94 there is attached, again by any suitable fastening or securing means, a second bearing block 75. Both of the bearing blocks 70 and 75 are operatively interconnected by a pivot bracket or strap 74. The pivot bracket 74 is pivotably connected, on the one hand, by a first bolt 76 with the second bearing block 75, and, on the other hand, by a second bolt 71 with the first bearing block 70. Both of the bolts 71 and 76 or equivalent structure are secured, in each case, by a disk 72 and a splint or keyway 73 or the like.

The mode of operation of the individual mounting and support points or locations, secured at the intermediate frame 94 and at the chassis frame 110, with the combat vehicle according to the first modification of FIGS. 5 and 6 will now be considered hereinafter and is as follows:

Starting, for instance, with the combat vehicle located in a given terrain, with the first modification, by means of the supports 15, 16 and 17, reposing upon the ground, the intermediate frame 94 together with the platform 210 and the weapon system secured thereon is mechanically aligned horizontally or leveled and stabilized in relation to the combat vehicle. The mounting and support points A', B' and C', according to the first modification, insure that both the torsional, bending and elongation forces, arising during vehicle travel and also upon weapon firing at the chassis frame 110, are not transmitted to the weapon system. In order to obtain a maximum depression or lowering of the weapon barrel of the weapon 200, as indicated by phantom lines in FIG. 5, with this variant embodiment there exists the possibility of lowering the combat vehicle 100, at its bow, in relation to the horizontally aligned or leveled intermediate frame 94. The lowering operation is accomplished, as will be described more fully hereinafter, by means of both mounting and support points or locations B' and C' operatively connected with one another by the shaft 65.

By means of the cylinder unit 64, the rack 67 and the gear 69 the shaft 65 is rotated, along with the disk 60 secured thereon, in the direction of the arrow Y (FIG. 7). Consequently, the bearing element 68 rotatably secured at the disk 60 and positively guided in the recess 56 of the bearing block 55 is moved downwardly from the center (rest position according to FIG. 8) of the bearing block 55 towards the outside and at the same time along the pivot line 57 extending about the lengthwise axis of the shaft 65, and thus, the vehicle is lowered at its bow side (FIG. 5).

In FIG. 8*a*, where to improve clarity in illustration there has not been shown in the course of movement of the disk 60, the bearing block 55 has been shown in a central position, indicated by phantom lines, and in a terminal position. The central position corresponds to a rotation of the shaft 65 through an angle of about 90° and the terminal position corresponds to rotation of the shaft 65 through an angle of about 180°. The width of the bearing block 55 is dimensioned such that the bearing element 68, in the central or middle position, still is adequately guided in the recess 56.

With the first variant construction of mounting and support points or locations A', B' and C', as shown in FIGS. 5 to 11, there is obtained, on the one hand, a harmonic course of movement with stable end positions for the lowering operation, and, on the other hand, a stable play-free attachment of the weapon system at the combat vehicle. Angular and displacement movements at the mounting and support points B′ and C′ are taken-up by means of the spherical part or ball mounted in the ball socket and by the bearing pin or journal axially displaceable in the spherical part or ball (FIG. 9).

The mounting and support point A′ shown in FIGS. 10 and 11, is structured so as to have three degrees of freedom of movement and renders possible, on the one hand, a movement directed in the lengthwise direction of the vehicle and shown in FIG. 10 by a pivot line 77, about the lengthwise axis of the first bolt 76 arranged transversely with respect to the vehicle-lengthwise direction, and, on the other hand, a movement directed transversely with respect to the vehicle-lengthwise direction and illustrated in FIG. 11, by a pivot line 78, about the lengthwise axis of the bolt 71 arranged in the lengthwise direction of the vehicle.

Now in FIGS. 12 and 13 there is shown a still further modification of an intermediate frame 95 and its mounting or support arrangement at the chassis frame 110 of the vehicle 100. Also with this variant embodiment the parts 100, 110 and 150 and the not particulary shown parts 160, 200, 210, 220 and 250, correspond to those shown, and indicated by the same reference characters, with the combat vehicle of FIG. 1.

In the top plan view according to FIG. 13 there is shown a portion of the combat vehicle without its weapon. There will be specifically apparent the arrangement of the mounting and support points A″, B″ and C″ in spaced relationship with respect to one another.

FIG. 14 shows the mounting and support point or location A″ in front view, looking in the direction of the arrow R in FIG. 12. The intermediate frame 95 of box-shaped configuration has been portrayed in its lowered position, and at this location such intermediate frame 95 possesses a pocket or depression 96 essentially formed by two oppositely situated side walls 97 and 97′. In the pocket or depression 96 there is arranged a crank-shaft-like constructed actuation element 80 operatively connected with the intermediate frame 95 and a bearing block 101 secured by any suitable fixation means at the chassis frame 110. The actuation element 80 possesses a shaft 81, a gear 82 rigidly connected for rotation with the shaft 81, two spaced and essentially mutually parallelly arranged disks or plates 84 and 84′ interconnected by means of a shaft 83, and finally, a bearing journal or pin 85 fixedly connected with the disk 84′. The shaft 83, interconnecting both of the disks 84 and 84′ with one another, is arranged eccentrically with respect to the center of such disks. The shaft 81 is rotatably mounted in the side wall 97 and the bearing journal 85 in the side wall 97′.

FIGS. 15 and 15*a* illustrate the mounting and support point A″ in side view taken along the line K—K of FIG. 14. In FIG. 15 the intermediate frame 95 is shown in its lowered position and in FIG. 15*a* in its raised position. The bearing block 101 is constructed preferably as a bifurcated or forked member serving for receiving and mounting a pivot element 102 and is provided at each bifurcated part with a not further shown and designated bore. The pivot or pivotal part 102 is mounted in the related bore of the bearing block 101 by means of two bearing pins or journals 103 laterally secured at the pivotal part 102 and serves for the rotatable mounting or support of the shaft 83 attached at the crankshaft-like structured actuation element 80.

Both of the mounting and support points or locations B″ and C″ are essentially of the same construction and symmetrically arranged relative to one another at the intermediate frame 95.

In the description to follow there will be described therefor in detail only the mounting and support point C″. In FIG. 16 this mounting and support point C″ has been shown in front view and on an enlarged scale, the view being taken along the line L–M of FIG. 13. There will be recognized a shaft 105 arranged in the intermediate frame 95 transversely with respect to the travel direction of the combat vehicle. The shaft 105 is rotatably mounted in two mutually spaced side walls 104 and 104′ of the intermediate frame 95. Both of the shafts 81 and 105, arranged transversely with respect to the travel direction of the vehicle and essentially in parallelism with one another, are actuated, according to the direction of the arrow Z shown in FIGS. 14 and 16, by the cylinder unit 107 schematically shown in FIG. 13. The cylinder unit 107 is operatively connected by a traction element, preferably by means of endless chain 108 both with a gear 106 rigidly connected for rotation with the shaft 105 and with the gear 82 rigidly connected for rotation with the shaft 81.

At both ends of the shaft 105 there is provided a respective disk or plate 86 which is rigidly connected with the shaft 105. At each disk 86 there is eccentrically attached a respective bearing pin 87. Arranged in spaced relationship from the disk 86 is a bifurcated bearing block 101′ for mounting a pivotal part 102′. The bifurcated bearing block 101′ is secured, by any suitable securing means, at the chassis frame 110. This bearing block 101′ and the pivotal or pivotable part 102′ essentially correspond to the elements 101 and 102 according to the embodiment of FIG. 14.

Now FIGS. 17 and 17*a* show the mounting and support point C″ in side view according to the line N—N shown in FIG. 16. More specifically, FIG. 17 illustrates the intermediate frame 95 in its lowered position, while FIG. 17*a* shows such intermediate frame in its raised position.

The mode of operation of the indvidual mounting and support points or locations A″, B″ and C″, secured both at the intermediate frame 95 and at the chassis frame 110, in conjunction with the combat vehicle, for the further embodiment of FIGS. 12 and 13 now will be described hereinafter:

Also the mounting and support points A″, B″ and C″ of the embodiment according to FIGS. 12 to 17 insure for a harmonic course of movement with stable end or terminal positions, for the lowering and raising operations of the intermediate frame with the weapon system, not shown in the drawings for this embodiment. Equally here, the torsional, bending and elongation forces, effective during vehicle travel and during weapon firing at the chassis frame, are not transmitted to the weapon system. The lowering and raising operations are accomplished in such a manner that, by means of the cylinder unit 107 and the chain 108 both of the shafts 81 and 105 are conjointly moved in the direction of the arrow Z. Due to the rotational movement Z both of the shafts 81 and 105 together with the disks 86 are rotated through 180°, about the not particularly designated lengthwise axis of the journals 83 and 87 mounted at the pivotal parts 102 and 102′ of the bearing blocks 101 and 101′, respectively, along a pivot line 88 and 88′, respectively. This pivotal movement is accomplished from one terminal position into the other terminal position, with the result that the intermediate frame 95, operatively connected with both shafts 81 and 105, is lowered or raised, essentially parallel and in relation to both the chassis frame 110 and in relation to its starting position.

The mounting and support points or locations, illustrated in FIGS. 14 to 17, render possible, by means of the pivotal elements mounted in the bearing blocks, on the one hand, a movement transversely with respect to the lengthwise direction of the vehicle and illustrated by a pivot line 89 and 89' in FIGS. 14 and 16, respectively, and for which purposes there is provided a corresponding spacing between the bearing blocks and the disks.

A movement essentially in the lengthwise direction of the vehicle and shown in FIGS. 15, 15*a* and FIGS. 17, 17*a*, by a pivotal line 111, 111', is rendered possible by means of the shafts 81, 105 connected in parallel by the chain 108 or equivalent structure and is a direct function of the chain sag. This chain sag or hang is predominantly determined by both of the tension wheels 109 and 109' mounted in any suitable fashion at the intermediate frame 95. In the end or terminal positions of the intermediate frame 95 the rear mounting and support point A'' can be blocked mechanically by a wedge (not shown) or equivalent blocking element, so that the chain 108 is load relieved. The wedge, depending upon the position of the intermediate frame—whether it is lowered or raised—can be inserted either from above or below into the pocket 96, and to which end both of the disks 84 and 84' are structured to be correspondingly beveled or flattened at one side, these flattened portions forming contact surfaces.

While there are shown and described present preferred embodiments of the invention, it is to be distinctly understood that the invention is not limited thereto, but may be otherwise variously embodied and practiced within the scope of the following claims. Accordingly,

What we claim is:

1. An apparatus for supporting a weapon system upon a mobile combat vehicle, comprising:

a combat vehicle-chassis frame;

a platform upon which the weapon system is mounted for rotational movement about a substantially vertical axis;

an intermediate frame;

three support devices arranged in spaced relationship from one another for mounting the weapon system arranged at the platform together with the intermediate frame at the chassis frame of the combat vehicle;

said support devices being operatively connected with the intermediate frame and the chassis frame;

said support devices being structured for taking-up angular and displacement movements and, viewed in the travel direction of the vehicle, for lowering and raising the intermediate frame supporting the weapon system at least at one side in relation to the chassis frame;

a respective displacement cylinder means operatively connected with the intermediate frame and the chassis frame and provided for each of the support devices;

said support devices including two support devices arranged at an end region of the intermediate frame; and said two support devices, viewed in the plane of the intermediate frame, being arranged at an angle with respect to one another in the order of about 120°.

2. The apparatus as defined in claim 1, further including:

a bearing pin for each support device secured at the intermediate frame;

a housing means in which there is axially displaceable and angularly movable said bearing pin;

said housing means being provided with a support element arranged essentially centrally in a guide element of the chassis frame and an articulated spacer element supported at the guide element.

3. The apparatus as defined in claim 2, further including:

pivot bearing means having an axis;

said spacer element articulated at the housing means being pivotable about the axis of said pivot bearing means; and a pawl articulated at the housing means for retaining the spacer element in its pivoted position.

4. An apparatus for supporting a weapon system upon a mobile combat vehicle, comprising:

a combat vehicle-chassis frame;

a platform upon which the weapon system is mounted for rotational movement about a substantially vertical axis;

an intermediate frame;

three support devices arranged in spaced relationship from one another for mounting the weapon system arranged at the platform together with the intermediate frame at the chassis frame of the combat vehicle;

said support devices being operatively connected with the intermediate frame and the chassis frame;

said support devices being structured for taking-up angular and displacement movements and, viewed in the travel direction of the vehicle, for lowering and raising the intermediate frame supporting the weapon system at least at one side in relation to the chassis frame;

said support devices comprising supports secured at the intermediate frame;

the intermediate frame which is operatively connected with the chassis frame by the support devices together with said weapon system being capable of being leveled and stabilized by said supports secured at the intermediate frame;

said intermediate frame being lowerable at its bow side in relation to the leveled intermediate frame in order to obtain a maximum depression of the weapon system of the vehicle;

said support devices comprise three support devices;

at least one of said support devices is structured for obtaining a movement of the intermediate frame oriented in the direction of travel of the vehicle and movement of the intermediate frame extending transversely thereto; and a shaft arranged transversely with respect to the direction of vehicle travel and mounted at the intermediate frame for operatively interconnecting both of the other support devices in order to obtain a lowering movement of the chassis frame extending about the lengthwise axis of said shaft.

5. An apparatus for supporting a weapon system upon a mobile combat vehicle, comprising:

a combat vehicle-chassis frame;

a platform upon which the weapon system is mounted for rotational movement about a substantially vertical axis;

an intermediate frame;

three support devices arranged in spaced relationship from one another for mounting the weapon system arranged at the platform together with the intermediate frame at the chassis frame of the combat vehicle;

said support devices being operatively connected with the intermediate frame and the chassis frame;

said support devices being structured for taking-up angular and displacement movements and, viewed in the travel direction of the vehicle, for lowering and raising the intermediate frame supporting the weapon system at least at one side in relation to the chassis frame;

the intermediate frame being operatively connected by the support devices with the chassis frame and can be selectively lowered and raised by a pivotal movement directed in the lengthwise direction of the vehicle and extending essentially parallel in relation to its starting position with respect to the chassis frame;

said support devices comprising at least three support devices;

a first shaft arranged transversely with respect to the direction of travel of the vehicle for operatively interconnecting two of said support devices with one another;

a second shaft arranged substantially parallel to the first shaft provided for the remaining support device;

bearing block means for securing both shafts at the interemdiate frame and at the chassis frame for rotation about their lengthwise axes; and an essentially intermittent actuatable traction element for operatively interconnecting both of the shafts with one another.

6. The apparatus as defined in claim 5, further including:

a substantially crankshaft-like configured actuation element for mounting said remaining support device in said related bearing block means of substantially bifurcated construction; and said support devices each being mounted in their related bearing block means of substantially bifurcated construction by a respective bearing pin arranged eccentrically with respect to the lengthwise axis of the first shaft.

7. An apparatus for supporting a weapon system upon a mobile combat vehicle, comprising:

a combat vehicle-chassis frame;

a platform upon which the weapon system is mounted for rotational movement about a substantially vertical axis;

an intermediate frame;

three support devices arranged in spaced relationship from one another for mounting the weapon system arranged at the platform together with the intermediate frame at the chassis frame of the combat vehicle;

said support devices being operatively connected with the intermediate frame and the chassis frame;

said support device being structured for taking-up angular and displacement movements and, viewed in the travel direction of the vehicle, for lowering and raising the intermediate frame supporting the weapon system at least at one side in relation to the chassis frame;

said support devices comprise supports secured at the intermediate frame;

the intermediate frame which is operatively connected with the chassis frame by the support devices together with said weapon system being capable of being leveled and stabilized by said supports secured at the intermediate frame;

said intermediate frame being lowerable at its bow side in relation to the leveled intermediate frame in order to obtain a maximum depression of the weapon system of the vehicle;

said support devices comprising three support devices;

at least one of said support devices being structured for obtaining a movement of the intermediate frame oriented in the direction of travel of the vehicle and a movement of the intermediate frame extending transversely thereto;

a shaft arranged transversely with respect to the direction of vehicle travel and mounted at the intermediate frame for operatively interconnecting both of the other support devices in order to obtain a lowering movement of the chassis frame extending about the lengthwise axis of said shaft;

said one support device comprising a first bearing block attached at the chassis frame and a second bearing block attached at the intermediate frame; and pivot bracket means and securing means for interconnecting the bearing blocks with one another.

8. The apparatus as defined in claim 7, wherein: said securing means comprise bolt means.

9. An apparatus for supporting a weapon system upon a mobile combat vehicle, comprising:

a combat vehicle-chassis frame;

a platform upon which the weapon system is mounted for rotational movement about a substantially vertical axis;

an intermediate frame;

three support devices arranged in spaced relationship from one another for mounting the weapon system arranged at the platform together with the intermediate frame at the chassis frame of the combat vehicle;

said support devices being operatively connected with the intermediate frame and the chassis frame;

said support devices being structured for taking-up angular and displacement movements and, viewed in the travel direction of the vehicle, for lowering and raising the intermediate frame supporting the weapon system at least at one side in relation to the chassis frame;

said support device comprise supports secured at the intermediate frame;

the intermediate frame which is operatively connected with the chassis frame by the support devices together with said weapon system being capable of being leveled and stabilized by said supports secured at the intermediate frame;

said intermediate frame being lowerable at its bow side in relation to the leveled intermediate frame in order to obtain a maximum depression of the weapon system of the vehicle;

a shaft arranged transversely with respect to the direction of vehicle travel and mounted at the intermediate frame for operatively interconnecting both of the other support devices in order to obtain a lowering movement of the chassis frame extending about the lengthwise axis of said shaft;

a respective bearing element provided at both ends of the shaft;

each of said bearing elements being arranged eccentrically with respect to the lengthwise axis of the shaft and rotatably upon a bearing journal and serving for taking-up angular and displacement movements; and each said bearing element being guided in a recess of a bearing block secured at the chassis frame.

* * * * *